US007318791B2

(12) United States Patent
Akhmetov

(10) Patent No.: US 7,318,791 B2
(45) Date of Patent: Jan. 15, 2008

(54) CARDIOVASCULAR SPINE EXERCISER

(76) Inventor: Zinnoor Akhmetov, 41 Armadale Close, London (GB) N17 9PJ ( * ) Notice: Subject to any disclaimer, the term of this patent is extended or adjusted under 35 U.S.C. 154(b) by 0 days.

(21) Appl. No.: 11/797,113

(22) Filed: May 1, 2007

(65) Prior Publication Data

US 2007/0213181 A1 Sep. 13, 2007

Related U.S. Application Data

(63) Continuation of application No. 10/982,811, filed on Nov. 8, 2004, now abandoned.

(30) Foreign Application Priority Data

Nov. 17, 2003 (GB) ..... 0326735
Jul. 5, 2004 (GB) ..... 0415060

(51) Int. Cl.
*A63B 22/00* (2006.01)
*A63B 23/02* (2006.01)
*A63B 23/035* (2006.01)

(52) U.S. Cl. ..... 482/51; 482/143; 434/255

(58) Field of Classification Search ..... 482/37, 482/44, 51, 56, 70, 75, 78, 79, 95, 96, 148, 482/141–143; 434/254–255; 472/120
See application file for complete search history.

(56) References Cited

U.S. PATENT DOCUMENTS 149,249 A * 3/1874 Redfearn ..... 482/56
326,247 A 9/1885 Root
1,176,365 A 3/1916 Hartnet
1,395,672 A * 11/1921 Fischer ..... 482/56
2,682,401 A * 6/1954 Perry ..... 482/96
3,976,058 A 8/1976 Tidwell
4,858,914 A 8/1989 Hix
5,707,320 A * 1/1998 Yu ..... 482/56
5,885,190 A * 3/1999 Reiter ..... 482/69

FOREIGN PATENT DOCUMENTS

GB 2 323 304 A 9/1998
GB 2 371 997 B 8/2002
WO WO 03049816 6/2003

* cited by examiner

*Primary Examiner*—Kevin C. Sirmons
*Assistant Examiner*—Victor K. Hwang

(57) ABSTRACT

A device for exercising and strengthening the muscles of the spinal column and vertebrae joints and for the spine recreation, designed taking in account that our backbone bio kinematics operate better moving in the horizontal position based on "four legs", comprises:

a bearing framework with fore and rear pivot points, two hand striding units and two foot striding units pivotally mounted to corresponding fore and rear pivot points and depending downwardly therefrom;

a kinematic transmission connecting the left and right pairs of the striding units with possibility to swing the hand and foot striding units in opposite direction, provides the user with a steady balance and allows to imitate a natural walking or running-type motions with the extremities based on the foot and hand supports while keeping his/her torso suspended freely above the foot and hand supports and with the spine in a substantially free horizontal position whereby the only support for the users body is the foot and hand supports;

The main and very individual training load is the user's own weight. Simulating running/galloping-type motions the user stretch and bends his/her spine in the vertical plane, performing walking motions the user bends his/her spine left and right in the horizontal plane, thus balanced exercising of muscles and joints of the spinal column is provided.

1 Claim, 3 Drawing Sheets

CARDIOVASCULAR SPINE EXERCISER

CROSS-REFERENCE TO RELATED APPLICATIONS

/Not Applicable/

STATEMENT REGARDING FEDERALLY SPONSORED RESEARCH OR DEVELOPMENT

/Not Applicable/

THE NAMES OF THE PARTIES TO A JOINT RESEARCH AGREEMENT

/Not Applicable/

INCORPORATION-BY REFERENCE OF MATERIAL SUBMITTED ON A COMPACT DISC

/Not Applicable/

BACKGROUND OF INVENTION

The present invention relates generally to exercise devices and more particularly, but not exclusively for exercising and strengthening the vertebrae and the muscles of the spinal column, for the spine recreation, for training cardiovascular system, Existing exercise apparatuses mainly simulate (reduplicate) what people do during 24 hours—stand, sit, lie, walk, jog etc. The cardiovascular spine exerciser being patented provides a new pose, new movement and excellent active recreation of the spine. When you are tired and your spine feels uncomfortable especially after monotone sedentary work, you try to stretch yourself, to hog,—exactly this "S"-image vertebrae pose gives you the cardiovascular spine exerciser.

Number of patents of walking trainers can be found:

U.S. Pat. No. 326,247, U.S. Pat. No. 1,176,365, U.S. Pat. No. 3,976,058, U.S. Pat. No. 4,858,914, GB2323304, WO03049816.

But mentioned exercisers don't provide a natural free horizontal position of the spine and are not designed for the spine exercising and recreation.

SUMMARY OF THE INVENTION

The principal purpose of this invention is the creation of a simple, universal and effective spine exerciser for exercising the vertebral joints, training the muscles of the spinal column and the musculoskeletal system as a whole, in condition which are most favourable and natural to the spine into its natural free "S" shaped horizontal position, in combination with the specific synchronization of the motions of arms and legs, i.e. with the natural synchronization of the forces being applied to the spine. As a human backbone construction is adapted better for movement in the horizontal position and the spine bio kinematics operate and exercise better moving in free horizontal position based on "four legs".

The cardiovascular spine exerciser being patented is designed goal-directed for training and strengthening the muscles of the spinal column, vertebrae joints and for the spine recreation. To achieve the above objects a cardiovascular spine exerciser for exercising and strengthening the muscles of the spinal column comprises:

a bearing framework consisting of:

a horizontal basis element;

supporting structures attached to the top of and extending upwardly from the horizontal basis element, said supporting structures having fore left and fore right pivot points and rear left and rear right pivot points at its upper parts, and allowing for the distance between said fore and rear pivot points to be adjustable;

left and right hand striding units each comprising a member pivotally mounted to respective fore left and fore right pivots and depending downwardly therefrom, said left and right fore members each having a lower distal end with a hand support adapted and configured to be grasped by a user's respective hand and to support at least a portion of the user's weight therefrom;

left and right foot striding units each comprising a member pivotally mounted to respective rear left and rear right pivots and depending downwardly therefrom, said left and right rear members each having a lower distal end with a foot support adapted and configured to engage a user's respective foot and to support at least a portion of the user's weight therefrom;

a kinematic transmission connecting said left hand striding unit with said left foot striding unit and allowing to swing said striding units in an opposite direction;

a kinematic transmission connecting said right hand striding unit with said right foot striding unit and allowing to swing said striding units in an opposite direction;

said kinematic transmissions comprise a shaft drive, a chain drive, a belt drive, a cord drive or a combination thereof;

BRIEF DESCRIPTION OF THE SEVERAL VIEWS OF THE DRAWINGS

The present invention will now be described by way of examples only and not in any limited sense with reference to the accompany drawings in which:

FIG. 9 and FIG. 11—striding units perform galloping motion,

FIG. 10 and FIG. 12—striding units perform walking motion;

DETAILED DESCRIPTION OF THE INVENTION

Figure 1:
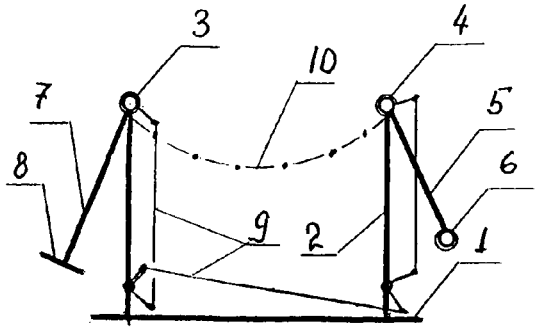
FIG. 1, FIG. 2—Side view, FIG. 3—view from above, FIG. 4—front view of the cardiovascular spine exerciser with two inwardly facing hand striding units pivotally attached to the top of fore supporting structures and two inwardly facing foot striding units pivotally attached to the top of rear supporting structures.
Figure 2:
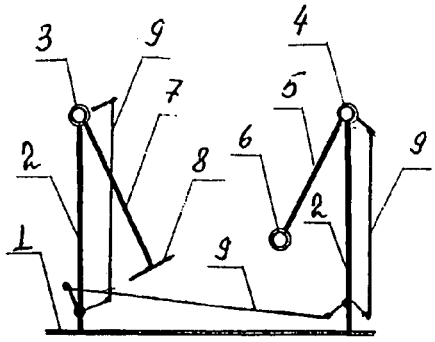
Figure 3:
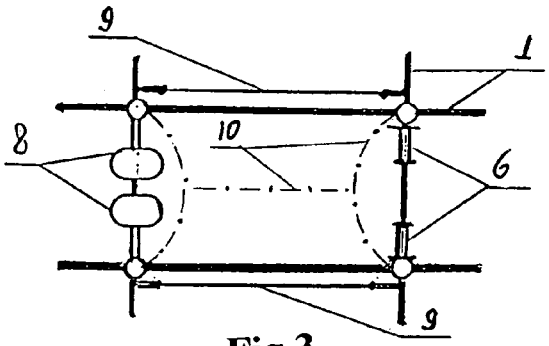
Figure 4:
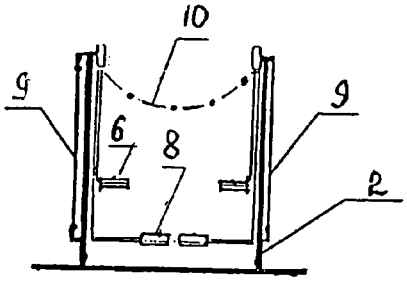

With reference to FIG. 1-FIG. 4 the first preferred embodiment of the cardiovascular spine exerciser for exercising and strengthening the muscles of the spinal column, comprising:

a bearing framework consisting of:

a horizontal basis element 1, supporting structures 2 attached to the top of and extending upwardly from the horizontal basis element 1, said supporting structures 2 having four pivot points at its upper parts making two rear pivot points 3 on one side of the horizontal basis element and two fore pivot points 4 at the opposite side of the horizontal basis element 1, the distance between the rear 3 and fore 4 pivot points is adjustable;

two hand striding units each comprising a member 5 pivotally mounted to respective left and right fore pivots 4 and depending downwardly therefrom, said left and right fore members 5 each having a lower distal end with inwardly facing hand support 6 adapted and configured to be grasped by a user's respective hand and to support at least a portion of the user's weight therefrom;

two foot striding units each comprising a member 7 pivotally mounted to respective left and right rear pivots 3 and depending downwardly therefrom, said left and right rear members 7 each having a lower distal end with inwardly facing foot support 8 adapted and configured to engage a user's respective foot and to support at least a portion of the user's weight therefrom;

wherein the hand supports 6 are generally positioned at a level above the foot supports 8 and spaced horizontally therefrom, such that a user may perform a striding motion on the foot and hand supports while keeping his/her torso suspended freely above the foot and hand supports with the spine in a substantially free horizontal position whereby the only support for the users body is the foot and hand supports;

a kinematic transmission 9 connecting said left hand striding unit 5,6 with said left foot striding unit 7,8 and said right hand striding unit 5,6 with said right foot striding unit 7,8, said kinematic transmission 9 allowing said right hand striding unit and said left hand striding unit to swing in opposite direction from their corresponding right foot striding unit and left foot striding unit, so the user, having a steady balanced position, can swing both hand striding units in phase with each other and in opposite direction from their said respective foot striding units to perform galloping-type motion, thus bending and stretching said user's spine in a substantially vertical plane, or the user can swing said right and left hand striding units and their respective right and left foot striding units in an opposing direction to perform walking-type motion, thus bending said user's spine left and right in a substantially horizontal plane; wherein said kinematic transmission 9 comprises a combination of a shaft drive, a chain drive, and a cord drive;

safety means 10 attached to said bearing framework for providing the secure exercising; friction type mechanisms of adjustable training load mounted into pivot points 3, 4 to change the resistance against the user performing walking or running motions.

The next embodiment of the cardiovascular spine exerciser FIG. 9-FIG. 12 wherein two longitudinal guide structures 11 attached to the upper part of supporting structures 2, said longitudinal guide structures each having said rear pivot point 3 and fore pivot point 4, the distance between the rear and fore pivot points is adjustable, said striding units, having said inwardly facing hand supports 6 and inwardly facing foot supports 8, mounted to respective fore and rear pivots;

wherein the kinematic transmission 9 between the striding units comprises of shaft drive, said kinematic transmission allowing said right hand striding unit and said right foot striding unit to swing in an opposite direction, and respectively said left hand striding unit and said left foot striding unit to swing in an opposite direction.

Figure 13:
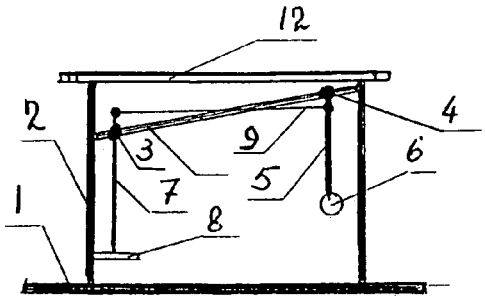
FIG. 13—side view, FIG. 14—front view, FIG. 15—view from above of the cardiovascular spine exerciser with outwardly facing hand striding units and outwardly facing foot striding units.
Figure 14:
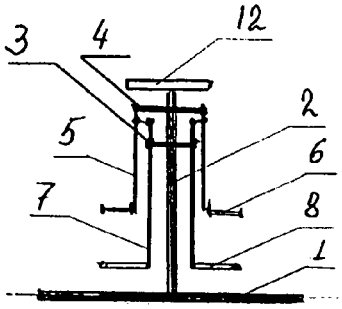
Figure 15:
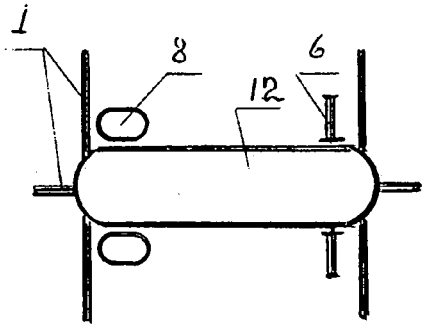

In a further aspect the present invention provides the cardiovascular spine exerciser FIG. 13-FIG. 15 wherein two outwardly facing foot striding units pivotally mounted to outer sides of respective left and right rear pivots 3 and depending downwardly therefrom, each foot striding unit having an outwardly facing foot support 8, two outwardly facing hand striding units pivotally mounted to respective left and right fore pivots 4 and depending downwardly therefrom, each hand striding unit having an outwardly facing hand support 6;

the kinematic transmission 9 between the striding units comprises of shaft drive, so the user can perform a striding motion based on the foot and hand supports while keeping his/her torso suspended above the rear 3 and fore 4 pivot points and safety mean 12 with the spine in a substantially free horizontal position whereby the only support for the users body is the hand supports 6 and the foot supports 8.

Figure 16:
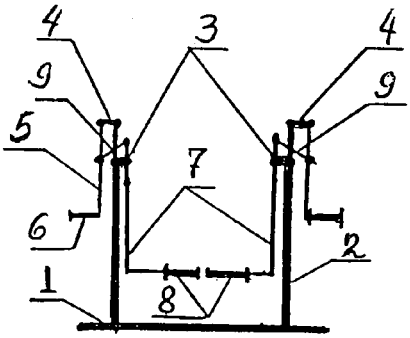
FIG. 16—front view, FIG. 17—side view, of the cardiovascular spine exerciser with outwardly facing hand striding units and inwardly facing foot striding units.
Figure 17:
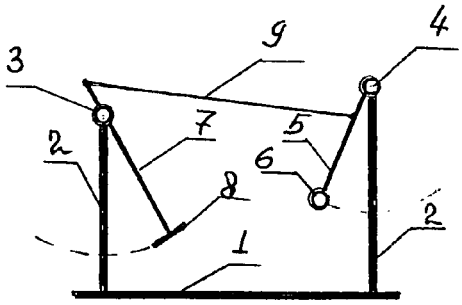

Another embodiment of the cardiovascular spine exerciser FIG. 16, FIG. 17 comprises: two outwardly facing hand striding units 5,6 pivotally mounted to outer sides of respective left and right fore pivots 4 and depending downwardly therefrom, each hand striding unit having an outwardly facing hand support 6, two inwardly facing foot striding units 7,8 pivotally mounted to inner sides of respective left and right rear pivots 3 and depending downwardly therefrom each foot striding unit having an inwardly facing foot support 8, The cardiovascular spine exerciser being patented is used as follows, see FIG. 5-FIG. 8, adjusted required distance between the rear and fore pivot points, an exercising is carried out by user positioned from above with limbs are based on the corresponding supports and with the spine in a substantially free horizontal position, by moving foot and hand supports forward and back the user provides good general physical training and exercises the deep muscles of the spine and vertebral joints.

Figure 5:
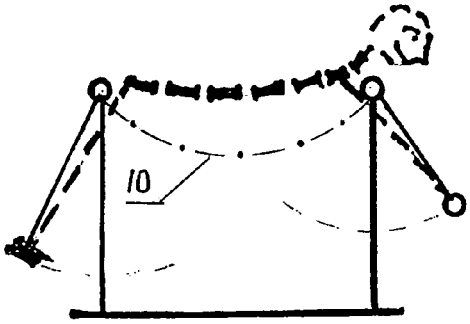
FIG. 5, FIG. 6—side view of the cardiovascular spine exerciser wherein the user performs galloping motions thus stretching and bending his/her spine in the vertical plane.
Figure 6:
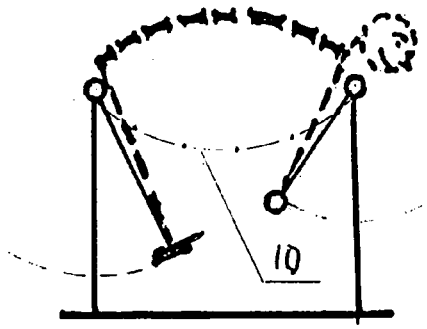
Figure 7:
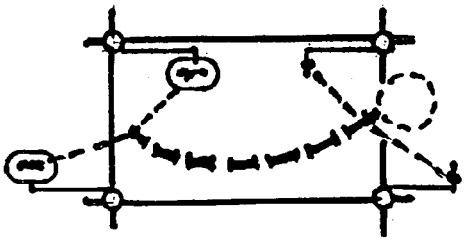
FIG. 7, FIG. 8—view from above of the cardiovascular spine exerciser wherein the user performs walking motions thus bending his/her spine left and right in the horizontal plane.
Figure 8:
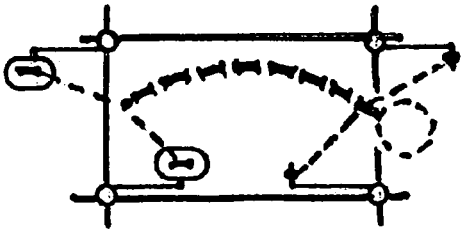
Figure 9:
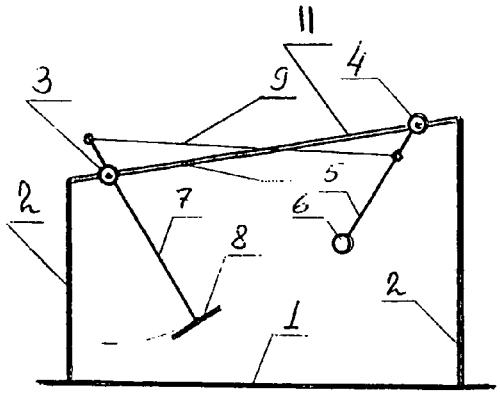
FIG. 9, FIG. 10—side view, FIG. 11, FIG. 12—view from above of the cardiovascular spine exerciser wherein said supporting structures comprise left and right longitudinal guide structures.
Figure 10:
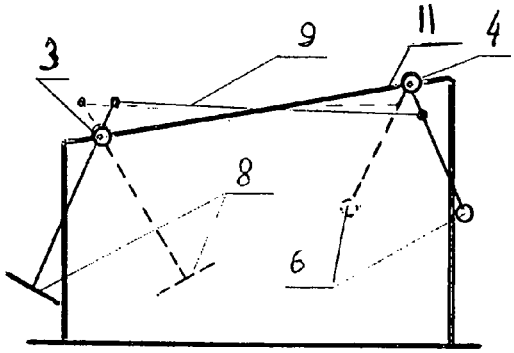
Figure 11:
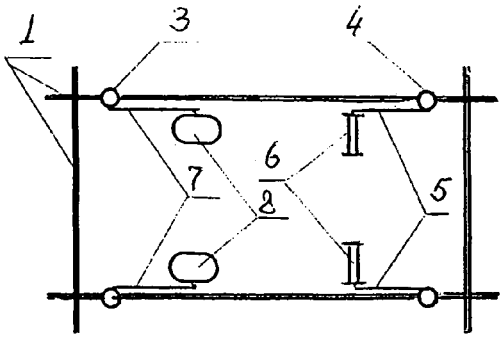
Figure 12:
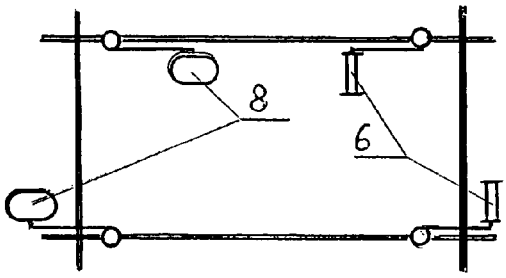

Simulating running/galloping-type motions FIG. 5-FIG. 6, the user are stretching and bending his/her spine in the vertical plane, performing walking motions FIG. 7-FIG. 8, the user are bending his/her spine left and right in the horizontal plane, thus balanced exercising of muscles and joints of the spinal column is provided.

Cardiovascular spine exercisers do not contain any complicated elements, there are simple to manufacture, and are comfortable and effective in the use, they have all qualities of notorious exercise bikes and additionally provide important benefits:

an active recreation of the spine strengthening of vertebrae joints and deep muscles, provide pliability of vertebrae, expansion of chest and elimination of slouch, massage of viscera (prostate), training with the horizontal spine position reduces load on the heart.

All mentioned above embodiments of cardiovascular spine exercisers provide free "S" shaped natural vertebrae position and even training load on the muscles of the spinal column, what provides favourable conditions for the posture correction.

They are recommended for sport and general physical well being, for the use by people with a sedentary or low-mobility way of life, for school children, students, for marine crew members and so on.

What is claimed is:

1. A cardiovascular spine exerciser for exercising and strengthening the muscles of the spinal column comprising:

a bearing framework consisting of:

a horizontal basis element, supporting structures attached to the top of and extending upwardly from the horizontal basis element, said supporting structures having fore left and fore right pivot points and rear left and rear right pivot points at its upper parts, and allowing for the distance between said fore and rear pivot points to be adjustable;

left and right hand striding units each comprising a member pivotally mounted to respective fore left and fore right pivots and depending downwardly therefrom, said left and right fore members each having a lower distal end with a hand support adapted and configured to be grasped by a user's respective hand and to support at least a portion of the user's weight therefrom;

left and right foot striding units each comprising a member pivotally mounted to respective rear left and rear right pivots and depending downwardly therefrom, said left and right rear members each having a lower distal end with a foot support adapted and configured to engage a user's respective foot and to support at least a portion of the user's weight therefrom;

wherein the hand supports are generally positioned at a level above the foot supports and spaced horizontally therefrom, such that a user may perform a striding motion on the foot and hand supports while keeping his/her torso suspended freely above the foot and hand supports with the spine in a substantially free horizontal position whereby the only support for the users body is the foot and hand supports;

a kinematic transmission connecting said left hand striding unit with said left foot striding unit and said right hand striding unit with said right foot striding unit, said kinematic transmission allowing said right hand striding unit and said left hand striding unit to swing in an opposite direction from their corresponding right foot striding unit and left foot striding unit, so the user, having a steady balanced position, can swing both hand striding units in phase with each other and in an opposite direction from their said respective foot striding units to perform galloping-type motions, thus bending and stretching said user's spine in a substantially vertical plane, or the user can swing said right and left hand striding units and their respective right and left foot striding units in an opposing direction to perform walking-type motions, thus bending said user's spine left and right in a substantially horizontal plane, wherein said kinematic transmission comprises a shaft drive, a chain drive, a belt drive, a cord drive or a combination thereof;

safety means attached to said support framework for providing for secure exercising; and a mechanism of adjustable training load to change the resistance against the user performing walking or running motions.

* * * * *